US006053175A

United States Patent [19]

D'Angelo

[11] Patent Number: 6,053,175

[45] Date of Patent: Apr. 25, 2000

[54] METHOD FOR TREATING SMOKING ARTICLE

[76] Inventor: Carmen A. D'Angelo, 200 Totem Trail, West Irondequoit, N.Y. 14617

[21] Appl. No.: 09/033,888

[22] Filed: Mar. 3, 1998

[51] Int. Cl.[7] ..... A24B 1/02

[52] U.S. Cl. ..... 131/300; 131/284; 131/274; 131/275; 131/290; 131/303

[58] Field of Search ..... 131/284, 274, 131/275, 290, 300, 303

[56] References Cited

U.S. PATENT DOCUMENTS

| | | | |
|---|---|---|---|
| 923,641 | 6/1909 | Goldsmith | 131/275 |
| 1,283,420 | 10/1918 | Nagle | 131/275 |
| 2,007,632 | 7/1935 | Blank et al. . | |
| 4,006,749 | 2/1977 | Horowitz et al. | 131/17 R |
| 4,243,056 | 1/1981 | De la Burde et al. . | |
| 4,452,257 | 6/1984 | Cartwright et al. | 131/310 |
| 4,466,451 | 8/1984 | Bonnet et al. . | |
| 4,537,204 | 8/1985 | Gaisch et al. . | |
| 4,804,002 | 2/1989 | Herron . | |
| 5,016,655 | 5/1991 | Waddell et al. | 131/310 |
| 5,370,139 | 12/1994 | Shu et al. . | |
| 5,413,122 | 5/1995 | Shu et al. | 131/274 |
| 5,615,694 | 4/1997 | Battard et al. . | |

*Primary Examiner*—James Derrington
*Assistant Examiner*—Robert McBride
*Attorney, Agent, or Firm*—Harter, Secrest & Emery LLP; Stephen B. Salai

[57] ABSTRACT

A method for treating a formed tobacco product/smoking article is disclosed. The method includes a two phase process. The first phase involves exposing the formed tobacco product to aromatic extracts to introduce vapor of the extracts to an interior of the tobacco product. To expose the tobacco product to the extracts, a cedar filament is moistened with a first extract and then wrapped around the product. After a predetermined time period, a second cedar filament may be moistened with a second extract and wrapped around the product for an additional time period, and so on. The second phase involves immersing the phase one treated tobacco product in a damp paste containing ground spices, flavored coffee, aromatic extracts, and flavored alcohol. Preferably, the paste covered product is kept in a humidor for a six week period, with the paste freshened weekly. A cigar treated by the method is also disclosed. Following the procedure, the cigar may be sealed in a cedar-lined aluminum tube with a bit of damp paste tucked in one end of the tube. A kit, usable by cigar enthusiasts, is also disclosed which includes the elements described in the method such as the ingredients, cedar filaments, humidor, measuring devices, mixing utensil, dropper, and may further include a cigar suitable for treating, an instruction manual containing directions for treating the cigar, and packaging materials.

32 Claims, 1 Drawing Sheet

METHOD FOR TREATING SMOKING ARTICLE

FIELD OF THE INVENTION

Generally, the present invention relates to a method for treating a previously formed tobacco product, such as a cigar. More particularly, the invention relates to sequentially exposing the tobacco product to aromatic extracts and subsequently covering the treated tobacco product with an aromatic damp paste. The invention further relates to smokable tobacco product treated by the method of the present invention, a preparation usable in the inventive method, and a kit designed for enthusiasts to prepare a smokable tobacco product using the inventive method.

BACKGROUND OF THE INVENTION

Popular smoking articles, such as cigars and cigarettes are employed by the smoker by burning one end thereof. In attempts to improve the smoking experience, various methods for altering the aroma or flavoring of the smoking articles have been proposed. Frequently, the cut filler (the shreds of strands of tobacco material) is treated with volatile additives such as top dressing or flavors in the form of an alcoholic solution. Casing materials, having a relatively low degree of volatility such as sugars, licorice, cocoa, essential oils, fruit extracts and humectants, are applied to the tobacco by dipping or spraying prior to the cutting or shredding operation. While these methods effectively provide an alteration in flavor and aroma of the smoking material upon burning during use due to the intimate contact in which the flavorant is applied to the tobacco, these methods must take place prior to the actual formation of the finished product. That is, a predetermined amount of tobacco and cut filler must be treated prior to the formation of the cigarettes which contain the treated tobacco in order for the cigarette to contain the desired aroma. The aromatized tobacco cannot be tested until the smoking article is formed, and it is sometimes difficult to know how much tobacco to treat to form a desired number of smoking articles.

U.S. Pat. No. 5,615,694 to Battard et al discloses a method for aromatizing the smoke of smoking articles by applying to its wrapper a solution of aromatizing substance which is transferred to the smoking article in vapor phase in the confined atmosphere of the packing of the smoking article. U.S. Pat. No. 2,007,632 to Blank et al discloses the use of flavor impregnated sticks to impart flavor to cigarettes which are within a package.

Cigars have been consumed much longer than cigarettes. In fact, it wasn't until the late 1700's that Cuban cigar makers made "little cigars", i.e. "cigarettes" using paper wrappers derived from cotton. Just recently however, as cigarette smoking has been decreasing in popularity and acceptance due to health risks, cigar smoking has been gaining in popularity with both men and women. Although the methods described by Battard et al and Blank et al may be used for treating finished tobacco products, they are directed primarily towards cigarette preparation, and therefore alternate methods for smoking article preparation particularly addressing the desires of cigar smokers is in need. There is further a need for an improved cigar, which carries various aromatic residues for bringing increased pleasure and intrigue to the cigar smoker. There is further a need for a preparation usable in treating a cigar for imparting aromatic residue in a cigar. There is further a need for a kit usable by cigar enthusiasts which provides the ingredients and directions for treating a cigar to form an improved cigar carrying aromatic residues and for bringing the fun of cigar treating to cigar fanatics.

SUMMARY OF THE INVENTION

It is an object of this invention to provide a method for preparing a cigar for men and women to enjoy over a long period of relaxation time or activity, such as intimate dining and conversation, golfing, recreational boating, or other outdoor activities, cigar sponsored events, and hot tub relaxation.

It is a further object of this invention to provide a method of treating a finished tobacco product, and more specifically for treating a cigar.

It is a further object of this invention to provide a method of treating a formed tobacco product which uses two phases: an oil extract preparation phase and a formulary preparation and storage cycle phase.

It is a further object of this invention to provide a method which imparts aromatic residue to a finished tobacco product by using cedar filaments moistened with oil extracts and wrapped around the product.

It is a further object of this invention to provide a method which imparts aromatic residue to a formed tobacco product by using a damp paste formed from ground coffee beans, ground spices, oil extracts, and flavored alcohol smeared on the tobacco product.

It is a further object of this invention to provide a preparation employing the ingredients of the damp paste, usable in treating a formed tobacco product.

It is a further object of this invention to provide a smokable tobacco product treated by the steps of the method of the present invention.

It is a further object of this invention to package a smokable tobacco product treated by the steps of the method of the present invention in a cylindrical glass or aluminum tube, and to place a small amount of the damp paste or treated leaf tobacco within the tube.

It is a further object of this invention to provide a kit for preparing and treating a smokable tobacco product according to the steps of the method of the present invention.

Other objects will in part be obvious and in part appear hereinafter.

In a preferred embodiment of the present invention, the method of treating a formed tobacco product first comprises the step of exposing the formed tobacco product to an aromatic extract to introduce vapor of the extract to an interior of the tobacco product to form a treated tobacco product.

Exposing may be accomplished by moistening a cedar filament with a first extract and rolling the tobacco product in the moistened cedar filament. Then, the tobacco product rolled in the cedar filament is preferably placed in a 70% humidified—68 degrees Fahrenheit environment for approximately 24 hours. Then, a second cedar filament is moistened with a second aromatic extract, different from the first aromatic extract, and the tobacco product is rolled in the second cedar filament and placed in the humidified environment for approximately an additional 24 hours. The cedar filament step is repeated with third and fourth aromatic extracts. On the fifth, sixth, and seventh days of the process, the extract prepared tobacco product is preferably left on its own in the humidified environment.

The method further preferably comprises the step of at least partially embedding the treated tobacco product in a damp paste of predetermined constituents. The embedding process includes the steps of grinding and blending hazelnut noisette flavored coffee beans, seville orange flavored coffee beans, and raspberry noisette flavored coffee beans to form a coffee mixture, adding ground cinnamon, ground cocoa, and ground anise seed to the coffee mixture to form a dry mixture, adding pure vanilla extract, pure peppermint extract, pure almond extract, and pure orange extract to the dry mixture to form a dry paste, and adding grappa and stregga to the dry paste to create a damp paste. The method further comprises the step of immersing the treated tobacco product in the damp paste by surrounding the tobacco product with at least ⅛ inch of paste and placing the tobacco product in a cedar lined humidor for approximately one week. A new damp paste is prepared weekly for six weeks and applied to the tobacco product weekly for a six week period. Following the six week period, the method further comprises the step of exhuming the tobacco product from the humidor and placing the product in a humidity controlled cedared room for one week. Following this storage cycle, the tobacco product may be enjoyed, or alternatively, it may be packaged by applying a small amount of the damp paste or treated tobacco leaf to an end of one of the product and a packaging tube and subsequently placing the product in a cylindrical glass or aluminum tube.

In the preferred embodiment of the present invention, the above-described method results in a smokable formed tobacco product comprising tobacco leaves having a residual flavorant from the oil extract preparation phase, the residual flavorant chosen from one of, but preferably all of, vanilla bean extractives, oil of peppermint, oil of bitter almond, and oil of orange, the cigar further being charged with aroma substances from a damp paste mixture comprising ground coffee beans, aromatic plant extracts, alcohol, cinnamon, cocoa, and anise seed. The cigar may be packaged in a glass or cedar-lined aluminum tube with a small amount of the damp paste mixture or treated tobacco leaf inserted in one end of the tube.

In another preferred embodiment of the present invention, a kit for treating a finished cigar, usable by cigar enthusiasts, preferably comprises a plurality of oil extracts, a plurality of cedar filaments sized to wrap around the cigar, a mixture of flavored coffee, a plurality of ground spices, and an instruction manual containing directions for treating a finished cigar. The kit may further include a finished cigar suitable for treating, flavored alcohol, measuring devices, a mixing utensil, a dropper, a cylindrical tube, adapted to hold a treated cigar, a cap for enclosing a treated cigar within the tube, an adhesive seal with removable backing for sealing the cap to the tube, and a humidor.

The foregoing and other features and advantages of the invention will be more readily understood and fully appreciated from the following detailed description, taken in conjunction with the accompanying drawings.

DETAILED DESCRIPTION OF THE PREFERRED EMBODIMENTS

Figure 1:
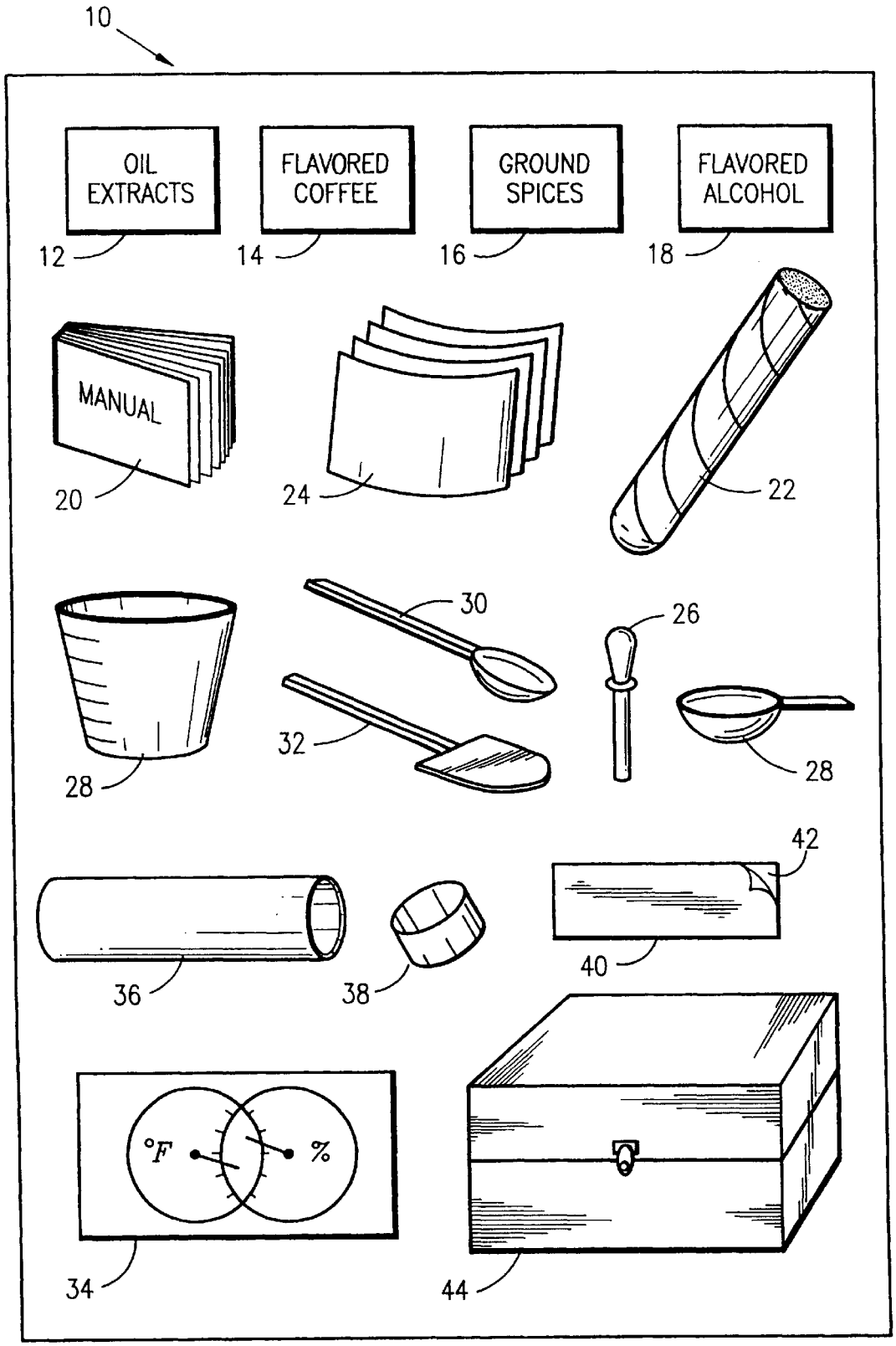
FIG. 1 shows a kit containing elements usable in treating a finished tobacco product according to a preferred embodiment of the method of the present invention.

The improved method for providing flavorant and aroma to a smoking article is described as follows with respect to the preparation of a single finished cigar 22. Of course, the method can be used for preparing multiple cigars or for preparing similar smoking articles. By "finished" it is meant that the cigar could be smoked as a regular cigar prior to being treated with the inventive procedure. Therefore, for the purposes of this application, a "finished" or "formed" tobacco product will indicate one which has not been passed through the inventive method and a "treated" tobacco product will indicate one which has undergone a portion of or all of the inventive method.

The preferred cigar 22 used is in the improved method is in the long panatela category, ring size 38 with Dominican Republic filler, Dominican Republic binder, and USA Connecticut shade wrapper aged for three years. Of course, other cigar types and similar tobacco products are within the scope of this invention. The method preferably comprises two phases, an oil extract preparation phase and a formulary preparation and storage cycle phase.

Phase I: Oil Extract Preparation Phase

The first phase preferably utilizes four specific oil extracts 12: pure vanilla extract, pure peppermint extract, pure almond extract, and pure orange extract. The pure vanilla extract preferably comprises vanilla bean extractives, 35% alcohol, and water. The pure peppermint extract preferably comprises oil of peppermint, 90% alcohol, and water. The pure almond extract preferably comprises oil of bitter almond, 35% alcohol, and water. The pure orange extract preferably comprises oil of orange, 80% alcohol, and water. The cigar in phase one is preferably treated by these oil extracts in a seven day preparation.

On day one, a cedar filament 24 sized to wrap around the cigar (approximately 6.5 inches by 2 inches for the above-described cigar) is moistened with preferably 8 gtts. (drops) of the pure vanilla extract followed by gently rolling and wrapping the cigar 22 with the treated individual cedar filament for approximately 24 hours in a 68° (degree)—70% (percent) humidified environment.

On day two, a cedar filament 24 is moistened with 8 gtts. of the pure peppermint extract followed by gently rolling and wrapping the cigar 22 with the treated individual cedar filament for preferably 24 hours in a 68°—70% humidified environment.

On day three, a cedar filament 24 is moistened with 8 gtts. of the pure almond extract followed by gently rolling and wrapping the cigar 22 with the treated individual cedar filament for preferably 24 hours in a 68°— 70% humidified environment.

On day four, a cedar filament 24 is moistened with 8 gtts. of the pure orange extract followed by gently rolling and wrapping the cigar 22 with the treated individual cedar filament for preferably 24 hours in a 68°— 70% humidified environment.

On days five, six, and seven, that is, for the next seventy two hours, the completed handmade oil extract prepared cigar is left on its own in a 68°—70% humidified environment.

Phase II: Formulary Preparation and Storage Cycle

The second phase begins by preparing the following formula: Combine 2 ounces of arabica whole coffee beans hazelnut noisette flavored, 2 ounces arabica whole coffee beans seville orange flavored, and 2 ounces arabica whole coffee beans raspberry noisette flavored. Finely grind and blend the coffee beans 14 as a dry mixture totaling 6 ounces. Mix together 4 tablespoons of ground cinnamon, 2 ounces of finely ground cocoa, and 1 tablespoon of finely ground anise seed as another dry mixture, and then combine this mixture with the previously ground arabica coffee bean blends into one dry mixture such that each ingredient is evenly blended and distributed in the mixture.

After the dry mixture is created, one tablespoon of each of the phase one oil extracts 12 is added to the dry mixture.

That is, one tablespoon of pure vanilla extract (vanilla bean extractives, 35% alcohol, and water), one tablespoon of pure peppermint extract (oil of peppermint, 90% alcohol, and water), one tablespoon of pure almond extract (oil of bitter almond, 35% alcohol, and water), and one tablespoon of pure orange extract (oil of orange, 80% alcohol, and water) is mixed with the dry mixture to create a dry paste.

To the dry paste of oil extracts and coffee bean blends, add one ounce of grappa (an Italian brandy) (40% alcohol by volume) and one ounce of a sweet, spicey orange flavored yellow liqueur such as Strega (80 proof) and blend until a damp paste is created. Now the damp paste is ready for use to treat the phase one 7-day treated handmade cigar 22.

Encompass the phase one treated cigar 22 with the formulary prepared damp paste by surrounding the cigar with preferably a minimal ⅛ inch circumference of paste. Next, place the encompassed cigar 22 in a cedar lined 68° temperature and 70% humidity controlled humidor 44. The cedar lined humidor 44 is intended to be reused and should preferably be previously exposed to the formulary preparation for a minimum of six weekly cycles.

Weekly, for the next six weeks, the formulary preparation described above should be recreated and the cigar 22 inundated with the damp paste within the cedar lined humidor. The treated cigar 22, once seven weeks old, is exhumed and placed in a 68°—70% humidity controlled cedared room for one week. At the end of eight weeks of treatment, the cigar 22 may then be placed in a cedar filament lined 7.25 inch by 43 gauge aluminum tube or a cylindrical boro-silicate glass tube with sealed tube stopper 36 packaged in wooden boxes of ten cigars in a 68°—70% cedared room until shipment takes place.

Prior to placement in a tube, the label is applied and a small amount of formulary preparation or treated tobacco leaf is placed at the tuck or foot end before closing the tube 36 and applying the aluminum cap or sealed tube stopper 38 followed by an adhesive outer seal 40. Thus, the cigar 22 is exposed to the aromatic damp paste until the package is opened and the cigar is removed.

As the above described method is performed on a previously formed tobacco product, the steps of the method could be substantially replicated by a novice cigar treater. That is, the elements used in the method could be packaged in a kit with a manual describing the steps in the method, and sold to cigar enthusiasts, thus delivering the excitement to the enthusiast of preparing his own cigars which he could enjoy himself or package and give as gifts.

Turning now to FIG. 1, the kit 10 would preferably include the ingredients used in the method such as the oil extracts 12, ground coffee 14, and the ground spices 16. If the kit is sold in liquor-licensed stores, it could also include the flavored alcohols 18. In addition to a detailed instruction manual 20, the kit would preferably further include at least one cigar 22 suitable for treating, some cedar filaments 24, a dropper 26 for the phase one treatment, and an assortment of measuring devices 28 and mixing utensils 30, and possibly even a spatula 32 for use in the phase two treatment. The instruction manual 20 could include historical information about cigar making and other information interesting to a cigar fanatic. A humidity tester and temperature gauge 34 may also be included for testing the environment used to store the cigar. Packaging materials such as the bor-silicate glass or cedar lined aluminum tube 36 with cap 38 and adhesive backed seal 40 with removable backing 42 could also be included for storing the treated cigar or wrapping as gifts. More extravagant kits could include a humidor 44 and other cigar-related paraphernalia, not shown.

Thus, it is apparent that there has been provided, in accordance with the invention, a cigar and method for treating a cigar that fully satisfies the objects and advantages set forth above. While the invention has been described in conjunction with specific embodiments thereof, it is evident that many alternatives, modifications, and variations will be apparent to those skilled in the art in light of the foregoing description. For example, larger and smaller cigars would require larger and smaller amounts, respectively, of the disclosed preparatory ingredients. Accordingly, the present invention is intended to embrace all such alternatives, modifications, and variations as fall within the spirit and broad scope of the appended claims.

I claim:

1. A method of treating a formed smoking article, comprising:

(a) exposing the formed smoking article to an aromatic extract and introducing vapor of the extract to an interior of the smoking article to form a treated smoking article; and (b immersing the smoking article in an aromatic damp paste;

wherein the step of exposing the formed smoking article to an aromatic damp extract comprises moistening a cedar filament with the extract and rolling the smoking article the moistened filament.

2. The method according to claim 1 further comprising the step of placing the smoking article rolled in the cedar filament in a 70% humidified environment.

3. The method according to claim 2 further comprising the step of maintaining the humidified environment at approximately 68 degrees Fahrenheit.

4. The method according to claim 3 further comprising the step of removing the smoking article from the humidified environment after approximately 24 hours.

5. The method according to claim 4 wherein the aromatic extract is a first aromatic extract, the method further comprising the steps of removing the cedar filament, applying a second aromatic extract, different from the first aromatic extract, to a second cedar filament, rolling the smoking article in the second cedar filament and placing the smoking article in the humidified environment for approximately an additional 24 hours.

6. The method according to claim 5 further comprising the steps of removing the second cedar filament, applying a third aromatic extract, different from the first and second aromatic extracts, to a third cedar filament, rolling the smoking article in the third cedar filament and placing the smoking article in the humidified environment for approximately an additional 24 hours.

7. The method according to claim 6 further comprising the steps of removing the third cedar filament, applying a fourth aromatic extract, different from the first, second, and third aromatic extracts, to a fourth cedar filament, rolling the smoking article in the fourth cedar filament and placing the smoking article in the humidified environment for approximately an additional 24 hours.

8. The method according to claim 7, further comprising the steps of removing the fourth cedar filament and storing the smoking article for approximately 72 hours.

9. The method according to claim 1 further comprising, after the step of immersing the smoking article in an aromatic damp paste, the steps of applying a small amount of the damp paste to an end of one of the smoking article and a packaging tube and sealing the smoking article within the packaging tube.

10. The method according to claim 1 further comprising the steps, prior to the step of immersing the smoking article in a damp paste, of grinding and blending hazelnut flavored coffee beans, orange flavored coffee beans, and raspberry flavored coffee beans to form a coffee mixture, adding ground cinnamon, ground cocoa, and ground anise seed to the coffee mixture to form a dry mixture, adding pure vanilla extract, pure peppermint extract, pure almond extract, and pure orange extract to the dry mixture to form a dry paste, and adding brandy and orange flavored liqueur to the dry paste to create the damp paste.

11. The method according to claim 1 further comprising, prior to the step of immersing the smoking article in an aromatic damp paste, the step of combining at least one of ground spices, flavored coffee, and aromatic extracts with flavored alcohol to form the aromatic damp paste.

12. The method according to claim 4 wherein the step of immersing the smoking article in an aromatic damp paste comprises the step of surrounding the smoking article with at least ⅛ inch of paste.

13. The method according to claim 12 further comprising the step of placing the smoking article in a cedar lined humidor.

14. The method according to claim 13 wherein the step of placing the smoking article in a cedar lined humidor comprises maintaining the smoking article in the humidor for approximately one week.

15. The method according to claim 14 further comprising the steps of preparing a new damp paste weekly for six weeks and applying the new damp paste to the smoking article weekly for a six week period.

16. The method according to claim 15 further comprising the step of exhuming the smoking article from the humidor, following the six week period, and placing the product in a humidity controlled cedared room for one week.

17. The method according to claim 16 further comprising the step of applying a small amount of the damp paste to an end of one of the product and a packaging tube and subsequently placing the product in the packaging tube.

18. A method of treating formed smoking article, comprising the steps of:

exposing the formed smoking article to an aromatic extract, introducing vapors of the extract to an interior of the smoking article, and then immersing the smoking article in an aromatic damp paste; and applying a small amount of aromatic damp paste to an end of one of the smoking article and a packaging tube and then sealing the smoking article within the packaging tube.

19. A method of treating a formed smoking article, comprising the steps of immersing the smoking article in an aromatic damp paste, and applying a small amount of aromatic damp paste to an end of one of the smoking article and a packaging tube, and then sealing the smoking article within the packaging tube.

20. The method of claim 19 wherein the step of immersing the smoking article in an aromatic damp paste comprises the step of surrounding a substantial portion of the smoking article with a layer of the damp paste.

21. The method of claim 20 further comprising, prior to the step of immersing the smoking article in an aromatic damp paste, the steps of combining at least one of ground spices, flavored coffee, and aromatic extracts with flavored alcohol to form the aromatic damp paste.

22. The method of claim 21 further comprising, prior to the step of immersing the smoking article in the aromatic damp paste, the steps of exposing the smoking article to an aromatic extract and introducing vapors of the extract to an interior of the smoking article.

23. A method of treating a formed smoking article comprising the steps of (a) moistening a cedar filament with an aromatic extract;

(b) rolling the smoking article in the moistened cedar filament;

(c) introducing vapor of the extract to an interior of the smoking article;

(d) removing the cedar filament; and, (e) surrounding a substantial portion of the smoking article with a layer of aromatic damp paste.

24. The method of claim 23 wherein the step of introducing vapor of the extract comprises the steps of placing the smoking article rolled in the cedar filament in a humidified environment for approximately 24 hours.

25. The method of claim 23 wherein steps (a) through (d) are repeated at least two more times prior to conducting step (e), each repetition of steps utilizing a different aromatic extract.

26. The method of claim 23 further comprising the step of combining at least one of ground spices, flavored coffee, and aromatic extracts with flavored alcohol to form the aromatic damp paste.

27. The method of claim 23 further comprising the step of (f) placing the smoking article surrounded with damp paste in a humidor.

28. The method of claim 27 wherein steps (e) and (f) are repeated at least three more times, and further comprising the step of freshly preparing a batch of aromatic damp paste prior to each repetition of steps (e) and (f).

29. A method of treating a cigar comprising the steps of, in succession, moistening a first cedar filament with pure vanilla extract, rolling and wrapping the cigar in the first cedar filament, placing the cigar in a humidified environment for approximately 24 hours, removing the first cedar filament from the cigar, moistening a second cedar filament with pure peppermint extract, rolling and wrapping the cigar in the second cedar filament, placing the cigar in a humidified environment for approximately 24 hours, removing the second cedar filament from the cigar, moistening a third cedar filament with pure almond extract, rolling and wrapping the cigar in the third cedar filament, placing the cigar in a humidified environment for approximately 24 hours, removing the third cedar filament from the cigar, moistening a fourth cedar filament with pure orange extract, rolling and wrapping the cigar in the fourth cedar filament, placing the cigar in a humidified environment for approximately 24 hours, and removing the fourth cedar filament from the cigar.

30. The method of treating the cigar of claim 29 further comprising, subsequent the step of removing the fourth cedar filament, the step of placing the cigar in a humidified environment for approximately 72 hours.

31. The method of treating a cigar comprising the steps grinding a plurality of differently flavored coffee beans to form a first dry mixture, mixing together cinnamon, ground cocoa, and ground anise seed to form a second dry mixture, combining the first dry mixture with the second dry mixture to form a third dry mixture, adding pure vanilla extract, pure peppermint extract, pure almond extract, and pure orange extract to the third dry mixture to create a dry paste, blending brandy and orange flavored liqueur with the dry paste to create a damp paste, and encompassing the cigar with the damp paste.

32. The method of claim 31 wherein the step of encompassing the cigar with the damp paste comprises spreading at least a ⅛ inch layer of the damp paste on the cigar and further comprising the successive steps of placing the cigar encompassed with the damp paste in a humidor for approximately one week, and repeating the steps of the method for six weekly cycles.

* * * * *